US005796370A

United States Patent [19]

Courtonne et al.

[11] Patent Number: 5,796,370

[45] Date of Patent: Aug. 18, 1998

[54] ORIENTABLE ANTENNA WITH CONSERVATION OF POLARIZATION AXES

[75] Inventors: Véronique Courtonne, Toulouse; Dominique Morin, Muret; Jean-Claude Lacombe, Tournefeuille; Jean-Pierre Carbonell, Cugnaux; Didier Rene, Toulouse, all of France

[73] Assignee: Alcatel Espace, Courbevoie, France

[21] Appl. No.: 683,779

[22] Filed: Jul. 16, 1996

Related U.S. Application Data

[63] Continuation of Ser. No. 353,218, Dec. 1, 1994, abandoned.

[30] Foreign Application Priority Data

Dec. 2, 1993 [FR] France ..... 93 14452

[51] Int. Cl.[6] ..... H01Q 13/00

[52] U.S. Cl. ..... 343/781; 343/761; 343/839

[58] Field of Search ..... 343/781 LA, 781 P, 343/781 R, 756, 761, 839, DIG. 2

[56] References Cited

U.S. PATENT DOCUMENTS

| | | | |
|---|---|---|---|
| 842,351 | 7/1907 | Staaden | 343/761 |
| 3,276,022 | 9/1966 | Brunner | 343/781 CA |
| 3,407,404 | 10/1968 | Cook et al. | 343/781 CA |
| 3,562,753 | 2/1971 | Tanaka et al. . | |
| 3,696,432 | 10/1972 | Anderson et al. | 343/761 |
| 3,795,003 | 2/1974 | Meek et al. | 343/781 CA |
| 3,914,768 | 10/1975 | Ohm . | |
| 4,260,993 | 4/1981 | Aubry et al. | 343/781 CA X |
| 4,489,331 | 12/1984 | Salvat et al. | 343/781 CA |
| 4,535,338 | 8/1985 | Ohm . | |
| 4,668,955 | 5/1987 | Smoll . | |
| 4,755,826 | 7/1988 | Rao | 343/781 P |
| 4,786,912 | 11/1988 | Brown . | |

FOREIGN PATENT DOCUMENTS

| | | |
|---|---|---|
| 0139482 | 2/1985 | European Pat. Off. . |
| 2321613 | 11/1974 | Germany . |

OTHER PUBLICATIONS

French Search Report FR 139482.

*Primary Examiner*—Donald T. Hajec
*Assistant Examiner*—Tho Phan
*Attorney, Agent, or Firm*—Sughrue, Mion, Zinn, Macpeak & Seas, PLLC

[57] ABSTRACT

An antenna is orientable, directional and capable of use as a transmit and/or receive antenna. It includes at least one reflector, at least one source of electromagnetic radiation including means for exciting the source with two orthogonal linear polarizations and a mechanical system for positioning and holding the source and the reflector. The orientation of the antenna is made up of depointing and rotation about a preferred direction of propagation of the radiation and the mechanical system enables such rotation while keeping the source fixed, so conserving the orientation of the orthogonal linear polarization. A preferred embodiment of the antenna includes a parabolic main reflector and a hyperbolic auxiliary reflector in a Cassegrain geometry, and the mechanical system enables rotation of both reflectors about the preferred direction of radiation and holds the source fixed to conserve the orthogonal linear polarization axes of the beam. Applications include radar, direct broadcast satellites and telecommunications employing frequency re-use by polarization diversity, especially advantageous in space and airborne applications.

21 Claims, 8 Drawing Sheets

ORIENTABLE ANTENNA WITH CONSERVATION OF POLARIZATION AXES

This is a Continuation of application Ser. No. 08/353,218 filed Dec. 1, 1994 now abandoned.

BACKGROUND OF THE INVENTION

1. Field of the Invention

The field of the invention is that of antennas for transmitting and/or receiving electromagnetic radiation and in particular directional and orientable antennas adapted to transmit and/or to receive radiation in a specific and variable direction. An antenna of this kind can comprise a source of radiation and one or more reflectors, the shape of the reflector(s) and the disposition of the system of reflector(s) relative to the source determining the directional characteristics of the antenna obtained and the shape of the beam transmitted or received.

2. Description of the Prior Art

The present invention relates to many kinds of directional antenna known to the person skilled in the art, including parabolic antennas, Cassegrain antennas, Gregorian antennas, etc using either axial or "offset" illumination. An offset system has a main reflector whose aperture is eccentric to the axis of the surface in question. In the single-reflector situation the primary source disposed on this axis is inclined so that it points to the center of the reflector.

The invention is more particularly concerned with antennas adapted to transmit and/or to receive with two orthogonal linear polarizations when the success of their mission depends on this capability. This applies to some telecommunication antennas, for example, which use polarization diversity to enable reuse of the spectrum in a given band of frequencies. Another example concerns satellite broadcasting antennas for the DBS (Direct Broadcast by Satellite) and DTH (Direct to the Home) systems. Some radar systems perform independent measurements with orthogonal polarizations to determine the radar signature of a complex target, for example, or for meteorological and remote sensing applications.

Most prior art implementations of this kind have been fixed terrestrial systems or systems on board terrestrial or airborne vehicles.

The present invention is particularly advantageous when used in space, on board a satellite, an orbital space station, a probe or any other space platform.

A new problem can arise on attempting to extrapolate from prior art terrestrial systems to design a space system using polarization diversity, namely: the implicit reference axes available on the terrestrial surface, the vertical and the horizontal, do not exist in space. Consequently, conservation of these axes as reference axes is problematical.

This problem is not insurmountable and can even be solved very easily if various system constraints are accepted.

For example, a geostationary telecommunication satellite must usually be able to communicate with a relatively small number of fixed ground stations. The orientations of the orthogonal polarization axes used in a system of this kind can be arbitrary, provided that a few initial adjustments are made to the ground equipment before transmission of wanted information. The constraint to be accepted in this situation is that no temporal variation of the geometrical parameters of the link can be tolerated, without carrying out a new adjustment sequence. In the prior art this is no problem, or virtually no problem, since the geometrical parameters of the link with a geostationary satellite are in principle invariant.

The situation is different for a satellite in low Earth orbit, a polar orbit or an inclined orbit (Walker, Molnya, etc orbits); these orbits can be elliptical or circular. Satellites in such orbits move across the sky from the point of view of an observer at a fixed point on the terrestrial surface. Consequently, a link between any such "non-geostationary" satellite and a fixed ground station will be in a direction that varies continuously due to the movement of the satellite.

For these non-geostationary satellites there is not necessarily any insurmountable problem in using orthogonal linear polarizations provided that certain constraints on system design are accepted. For example, a linear polarization can be chosen parallel to the path of the satellite, known from astronomical tables, with the other polarization chosen perpendicular to this path and to the nadir. Each fixed ground station knows in advance the orientations of the polarization axes used by the satellite and the ground antenna can be adjusted accordingly.

The extent and the frequency of such adjustments will depend on the freedom to be allowed in respect of the geometrical parameters of the link established between the non-geostationary satellite and the ground station. If the link is used only when these parameters are identical or virtually so (small variations in their values can be tolerated within a range whose extent is determined by the cross polarization link balance), there is no foreseeable problem of interference between two transmission channels using the same frequency with orthogonal polarizations (this is polarization diversity).

However, this constraint is a problem in the prior art systems in that the possibility of orienting the onboard antenna is limited by the radio performance specifications promulgated by national and international regulatory bodies (FCC, CCITT, ITU, etc) for radio transmissions. In known systems the orientation of the antenna can cause performance to vary outside the narrow range allowed by such standards and specifications.

Frequency re-use through polarization diversity can also have advantages in direct satellite broadcasting. A user on the ground will not be obliged to re-orient his antenna to point at a second satellite in order to pick up a second "bouquet" of transmissions if a first satellite can provide the programs of the second bouquet along with those of the first bouquet, from the unique orbital position of the first satellite, using cross polarizations.

The invention is directed to remedying the drawbacks of the prior art for telecommunication satellites (transmit and/or receive antenna) and direct broadcast satellites (transmit antenna).

In meteorological and remote sensing radar systems, the polarization of the wave received by the equipment can be used to probe the target better. For example, backscattering and depolarization of the polarized wave transmitted by the satellite can reveal the nature of atmospheric precipitation, since the depolarization depends on the size, the concentration and the phase state (ice, liquid droplets, vapor), of the substances probed. To give another example, polarization measurements on radar backscattering from the surface of the sea can indicate how rough the sea is.

Sensitivity to polarization varies according to the mission. In these last two examples, the polarization of the initial wave can be arbitrary without this affecting the result because the targets themselves are not fixed but, to the contrary, have an arbitrary orientation.

The situation is different in observing a fixed target illuminated by a polarized wave at different moments in time. Such successive measurements can be used to observe the evolution of the target or to improve the signal to noise ratio and the resolution of the fixed image by correlating successive images (background subtraction). A typical case is the observation of the same geographical area or the same object on the ground on successive passes of a non-geostationary satellite. The successive orbits of any such satellite are usually not closed as seen from the terrestrial surface, but rather trace out a spiral advancing in the direction of longitude. This applies to heliosynchronous orbits, for example.

One problem with any such prior art system is that although the orthogonal polarization vectors can be arbitrary for isolated observations, they must be conserved for correlating successive measurements. However, these vectors tend to evolve for at least two reasons. Firstly, the precession of the orbit introduces variable but predictable geometric factors and, secondly, viewing the same location on the ground in successive orbits generates other variations of the geometrical parameters which must be allowed for in the correlations to be carried out.

Expressed in the most general terms, the new problem to which the invention is addressed is as follows: an antenna is required whose elements can be oriented at will to enable arbitrary orientation of the transmitted or received beam of radiation, whilst allowing conservation of orthogonal linear polarization axes regardless of the orientation of the beam. Moreover, the antenna of the invention must allow conservation of orthogonal linear polarization axes even in the situation in which the beam rotates about its main direction of propagation.

SUMMARY OF THE INVENTION

To solve this problem, the invention consists in an antenna including at least one reflector and at least one source of electromagnetic radiation, each source being capable of transmitting and/or receiving radiation in a primary direction which links said source to at least one reflector; said source including at least one radiating element and means for exciting said element, said antenna being adapted to transmit or to receive a beam of electromagnetic radiation of arbitrary cross-section and in a preferred radiation direction determined by the disposition and the orientation of said reflector and said source, said reflector having any shape and said beam having polarization axes conferred on it by the excitation applied to said source, said beam being orientable by movement of said antenna or its component parts, said antenna further including mechanical means which determine the relative disposition of said reflector and said source and enable said reflector to rotate about an electromagnetic radiation propagation axis while holding said source in a position such that the polarization axes remain fixed during said rotation.

The designer will determine the nature of the source to suit the mission to be accomplished. For example, the source can be a basic horn, a microstrip ("patch") radiator, a slot, etc or a complex or extensive source, for example an array of patches of slots, possibly associated with cavities. The complex source can be made up of a plurality of separate sources with a polarization-selective reflector or with a plurality of frequency-selective reflectors. The source can be a direct source or periscopic source. In brief, the invention can be implemented using any source known to the person skilled in the art for such applications.

In accordance with one feature of the invention, the movement of at least one reflector includes rotation of the reflector about the preferred direction of radiation. In accordance with another feature of the invention this movement includes angular displacement (depointing) of the preferred direction about a point which represents the position of the source. In one embodiment of the invention this movement includes rotation of the reflector about the radiation propagation direction linking the source to the reflector.

According to one specific feature of the invention the direction of propagation between the source and the reflector coincides with the preferred direction of radiation.

In one specific embodiment of the invention the at least one reflector is a single reflector having parabolic generatrices, the reflector being illuminated by the source disposed substantially at its focus, and the reflector can be turned about the radiation direction with the source fixed. The geometry of the system is centered.

In one embodiment of the invention the single parabolic reflector is illuminated by a source with an "offset" geometry and the reflector can be turned about the radiation direction with the source fixed.

In another specific embodiment of the invention the antenna includes at least two reflectors disposed in an offset or centered "Gregorian" geometry. The two reflectors are disposed with their concave surfaces facing each other and the illumination of each is either offset or centered.

In another and particularly advantageous embodiment of the invention the antenna includes at least two reflectors disposed in a Cassegrain geometry, namely a main reflector which reflects the beam and an auxiliary reflector which is illuminated by the source, and at least the main reflector can be turned about the preferred direction of radiation with the source fixed. In one embodiment of the invention the system of reflectors can be turned about the preferred direction of radiation with the source fixed. In accordance with an additional feature of the invention the antenna further includes mechanical means for depointing all of its component parts without modifying their relative disposition, in addition to the mechanical means previously described.

In all embodiments of the invention the focusing reflectors have an arbitrary shape; however, the invention will be particularly advantageous if at least one reflector has no axial symmetry (of rotation about an axis).

The reflector can be simple or complex.

For example, a complex reflector can be a dual gridded reflector made up of two reflectors disposed one in front of the other in a direction of propagation of the beam, the first reflector being reflective for a first linear polarization and transparent for an orthogonal second linear polarization which is reflected by the second reflector disposed behind the first reflector. This dual gridded type of reflector is well known to the person skilled in the art. In an embodiment of the invention using this type of reflector the mechanical means rotate the source, which is of any shape, and hold the reflector(s) fixed.

Other features and advantages of the invention will emerge from the following detailed description with reference to the appended drawings.

DETAILED DESCRIPTION OF THE PREFERRED EMBODIMENTS

The drawings show embodiments of the invention by way of non-limiting example. The same reference numbers in the various figures always denote the same items. Some of the figures are not to scale, to make them clearer.

Figure 1:
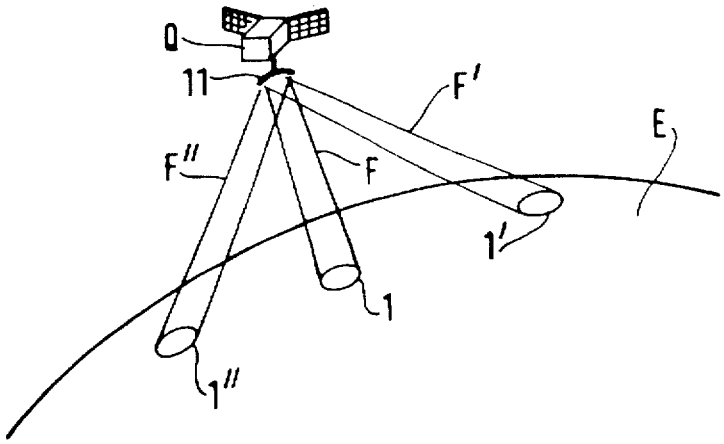
FIG. 1 is a diagrammatic representation of a satellite with an orientable beam in terrestrial orbit.

FIG. 1 is a diagram showing a satellite Q in Earth orbit.

The satellite has an orientable antenna; depending on the position of the reflector 11, the beam can be directed in various directions to illuminate different places on the Earth E. In the FIG. 1 example, the beam F directed towards the nadir illuminates the "spot" 1 and the beams F', F" respectively illuminate the spots 1', 1" ("spot" is the term of art denoting the trace on the ground of a narrow beam directed towards the Earth E).

The beam can be oriented either mechanically by positioning a main reflector 11 as shown diagrammatically in this figure or electronically in the case of an array antenna by altering the phases of the signal supplied to the individual sources of the array.

All of the remaining description refers exclusively to a transmit antenna. However, the person skilled in the art knows the reciprocal nature of the theory of passive antennas whereby an antenna operates in the same manner in transmission and in reception subject to inverting the sign of the time (t) in the equations describing electromagnetic propagation (Maxwell's equations).

Although the antenna of the invention is described in relation to transmission it is to be understood that the invention is equally concerned with a receive antenna having the same features and with a transmit/receive antenna such as a radar or telecommunication antenna. In these various embodiments, the amplification electronics associated with the antenna must be power amplification electronics in the case of a transmit antenna or low-noise amplification electronics in the case of a receive antenna or a combination of the two in the case of a transmit/receive antenna.

Figure 2:
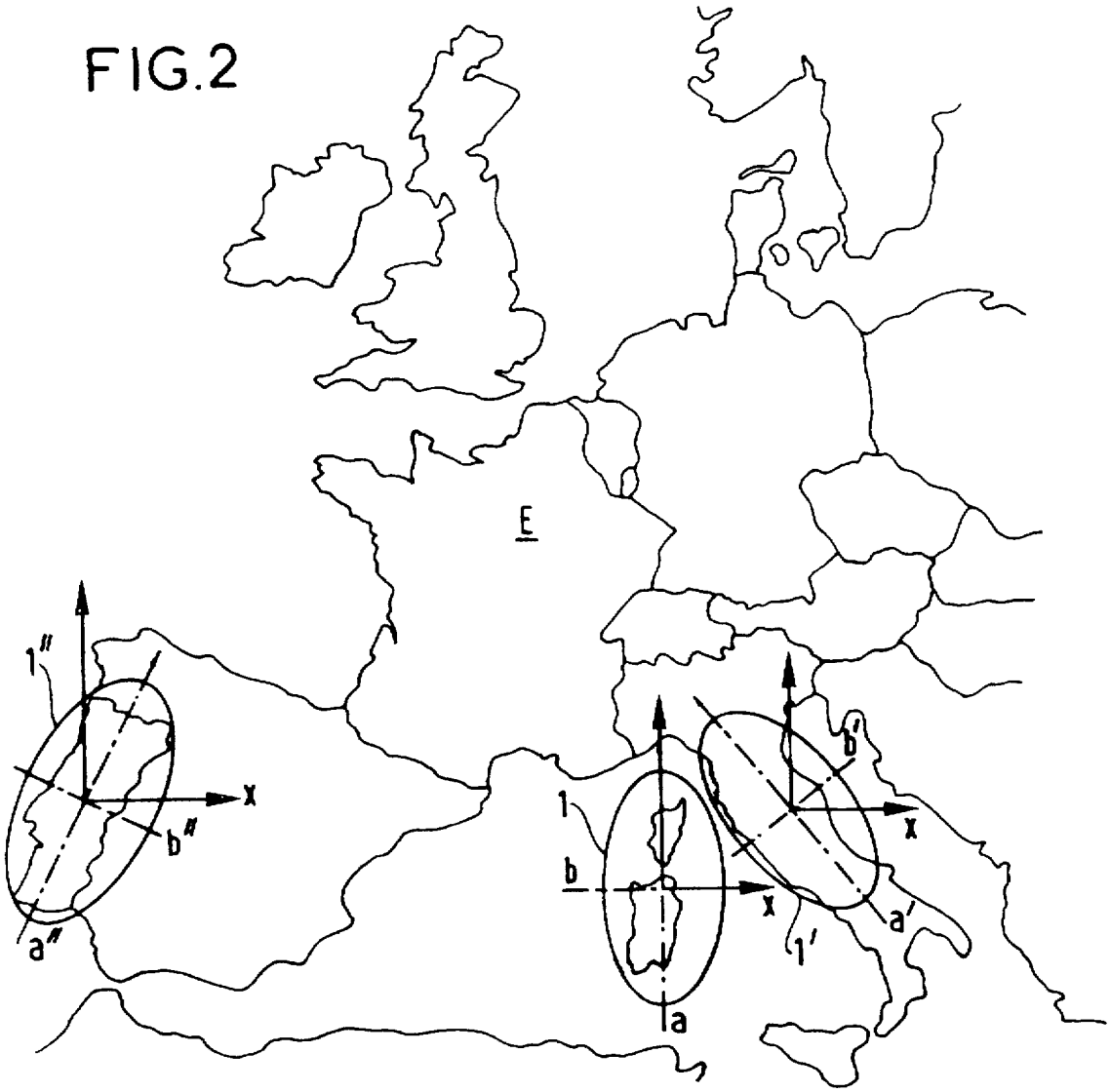
FIG. 2 shows diagrammatically the trace on the ground of an orientable beam from an orientable antenna of the invention with conservation of polarization.

FIG. 2 shows the traces on the ground of an orientable antenna of the invention with conservation of the linear polarization vectors along the x, y axes. In this example, spot 1 is an ellipse with axes a, b; the major axis of the ellipse is the a axis. The x, y polarization axes coincide with the axes a, b of an elliptical spot 1.

The elliptical spots 1', 1" are illuminated by the beams F', F" from FIG. 1, for example, obtained by orienting the orientable antenna 11. The relative orientation between the spots (1, 1', 1") can be obtained by a combination of depointing the antenna to move the spot in translation and rotation of the antenna about the main axis of the transmitted beam to rotate the axes of the ellipse.

In a prior art orientable antenna, the antenna is rotated about the main axis of the beam by mechanical means which physically turn the antenna about this main axis. If the antenna is fed by one or more sources with two orthogonal linear polarization axes, the polarization axes are subject to the same rotation as the axes of the spot on the ground. For the intended applications of the invention rotation of the polarization axes cannot be tolerated, as it would inevitably cause interference between signals conveyed by channels distinguished only by their polarization.

The antenna of the invention solves this problem to achieve the result shown in FIG. 2. Note that the spots 1', 1" can be illuminated by translation and rotation of the elliptical spot 1, but that the polarization axes (x, y) are retained regardless of the orientation of the axes (a', b'; a", b") of the elliptical spot (1', 1" respectively). In this example the elliptical spots are oriented for better coverage of the geographical areas indicated on the geopolitical map of Europe.

Figure 3:
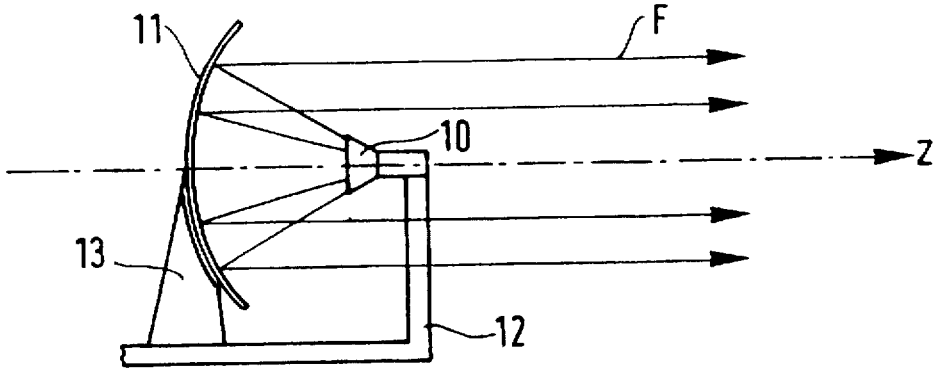
FIG.3 PRIOR ART
FIG. 3 is a diagrammatic lateral section of a parabolic prior art antenna.

To explain more clearly how the invention can solve the problem as stated, FIG. 3 is a diagrammatic representation in lateral cross-section of a prior art parabolic antenna. The essential components of this antenna are the focusing reflector 11 whose shape is a paraboloid of revolution about the axis of symmetry z and the source 10 at the focus of the reflector 11.

In this example the source is a horn 10 fed by a waveguide 12. Mechanical means 13 are provided to hold the source 10 at the focus of the reflector 11 in a fixed and optimal geometrical arrangement. The electromagnetic radiation emitted by the source 10 at the focus is reflected by the reflector 11 as parallel rays which form a beam F of radiation along the main axis z.

In the case of a main reflector 10 having symmetry of revolution, there is no need to rotate the antenna about the main axis z because the spot at the nadir will be circular.

Figure 4A:
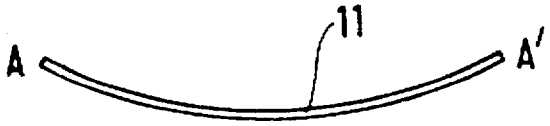
FIGS. 4A, 4B, 4C respectively show in cross-section on the line AA', in plan view and in cross-section on the line BB' one embodiment of an asymmetric parabolic reflector for an antenna of the invention.
Figure 4B:
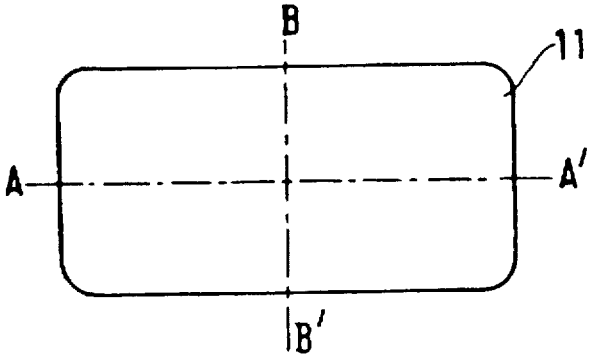
Figure 4C:
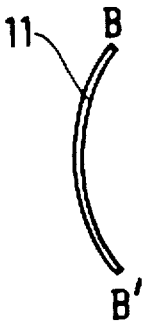

FIGS. 4A, 4B, 4C are different views of an asymmetric parabolic reflector adapted to form an elongate spot on the ground. The shape of the reflector 11 as seen in plan view in FIG. 4B is virtually rectangular. The cross-sections on AA', BB' in FIGS. 4A, 4C respectively, are paraboloid arcs of different length. The arcs can have the same focal length despite their different lengths, and the reflector 11 will have a single focus. The beam resulting from a source at the focus will have a rectangular cross-section.

Figure 5:
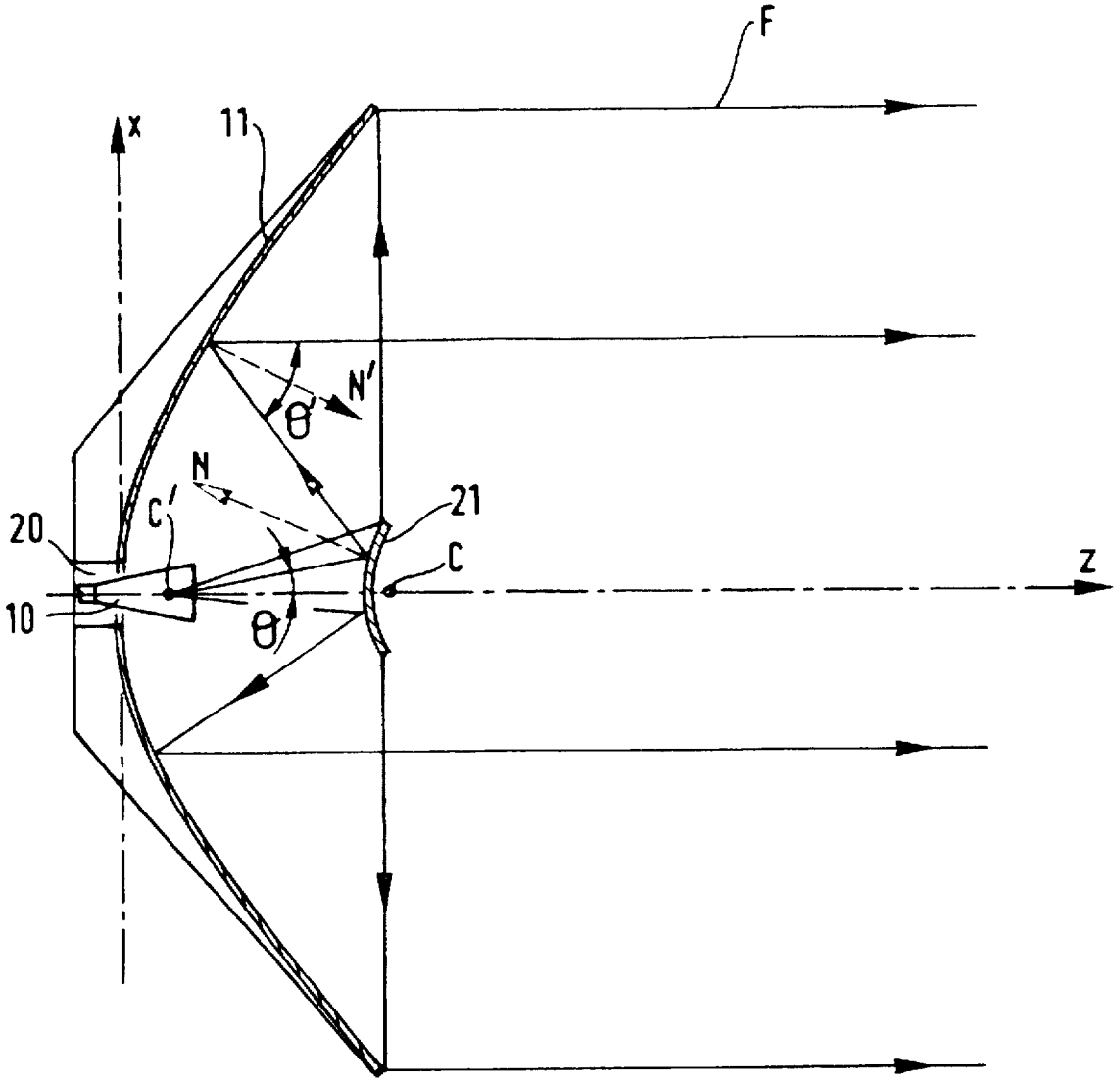
FIG. 5 is a diagrammatic representation in cross-section of the centered Cassegrain geometry.

FIG. 5 shows in cross-section a conventional Cassegrain geometry having a source 10 illuminating an auxiliary reflector 21 through a hole 20 in a parabolic main reflector 11. The conventional geometry is axisymmetric about the axis z which corresponds to the direction of propagation of the beam F. The source 10 is either disposed on the z axis (not shown) or imaged onto the axis by means of a periscopic third reflector (not shown).

The shape of the auxiliary reflector 21 is a hyperboloid whose first focus C coincides with the focus of the parabolic main reflector 11. The phase center of the source 10 is imaged at the second focus C' of the hyperboloid.

In this way, a ray emitted by the source 10 at the point C' at an angle θ to the z axis will be reflected from the surface of the auxiliary reflector 21 towards the main reflector 11 in a direction whose origin is the focus C of the parabolic main reflector 11. The rays arriving at the focus C are reflected by the parabolic main reflector with a reflection angle θ' to form a beam F in which all the rays are parallel to the z axis.

The vector N represents the normal to the surface of the auxiliary reflector 21 and the vector N' represents the normal to the surface of the main reflector 11.

Figure 6:
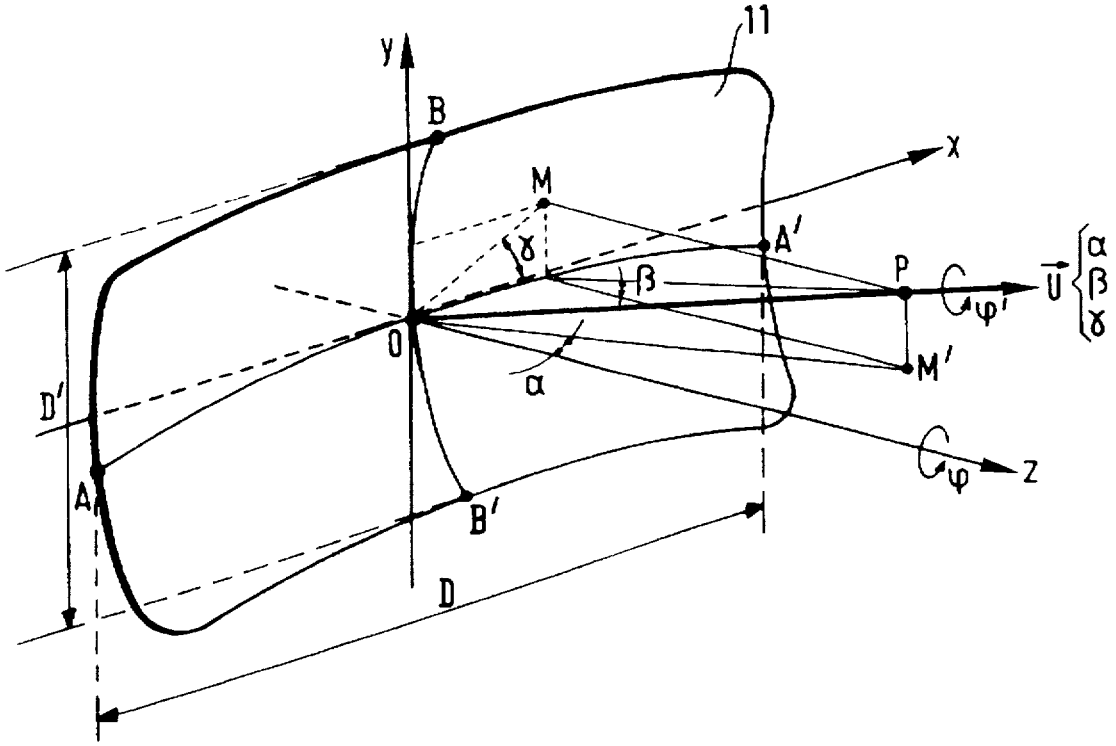
FIG. 6 is a diagrammatic three-dimensional perspective view of the parabolic reflector from FIGS. 4A, 4B, 4C with a system of coordinates used to describe the movements of the antenna of the invention.

FIG. 6 is a diagrammatic three-dimensional perspective view of the parabolic reflector (11) from FIGS. 4A, 4B, 4C with a system of coordinates used to describe movement of the antenna of the invention. The apex of the reflector 11 is at the origin O and the z axis represents the direction of propagation of reflected waves (not shown).

The parabolic reflector 11 is approximately rectangular in shape when projected onto a plane surface perpendicular to the z axis, for example the (x, y) plane.

D is its width in the x direction and D' is its height in the y direction. A section AA' in the (x, z) plane is a parabola and a section B'B in the (y, z) plane is a parabola, in conformance with FIGS. 4A, 4B and 4C.

The system has three degrees of freedom: rotation by an angle φ about the main axis z and depointing by two angles (α, β) in two orthogonal planes intersecting on the main axis z. The depointing can be represented by the unit vector $\vec{u}$ which is oriented in the direction angles (α, β, γ) to terminate at a point P of the z axis. The angle γ can be expressed as a function of the two independent variables (α, β).

The angle α represents the projection of the vector $\vec{u}$ onto the (x, z) plane and point N' the projection of the point P onto the same (x, z) plane.

The angle γ represents the projection of the vector $\vec{u}$ onto the (x, y) plane and point M the projection of the point P onto this same (x, y) plane. The angle β represents the projection of the vector $\vec{u}$ onto the (y, z) plane. The projection of the point P onto this plane is not shown in order to simplify the drawing.

Rotation of the reflector can be expressed either by the angle φ about the main axis z or by the angle φ' about the unit vector $\vec{u}$; these angles are not independent.

Figure 7:
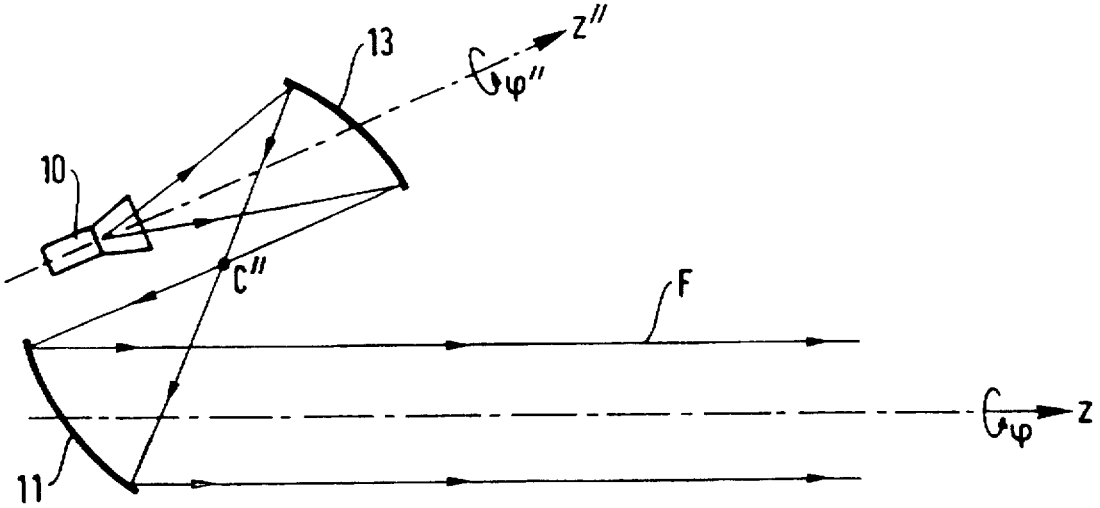
FIG. 7 is a diagrammatic cross-section of an offset illumination Gregorian geometry.

FIG. 7 is a diagrammatic cross-section of an offset illumination Gregorian geometry. The parabolic main reflector 11 is illuminated by the source 10 via an elliptical auxiliary reflector 13 off the main axis z of the beam F which is made up of parallel rays. The source 10 at the first focus of the ellipse emits towards the auxiliary reflector 13 along the z" axis and the waves are reflected towards the main reflector 11 and focused at a point C" (focus of the parabola and second focus of the ellipse), whence they diverge to illuminate all of the main reflector 11. This system therefore has two axes (z, z") about which rotation can be effected, either rotation by an angle φ about the z axis or rotation by an angle φ" about the z" axis, respectively.

Figure 8:
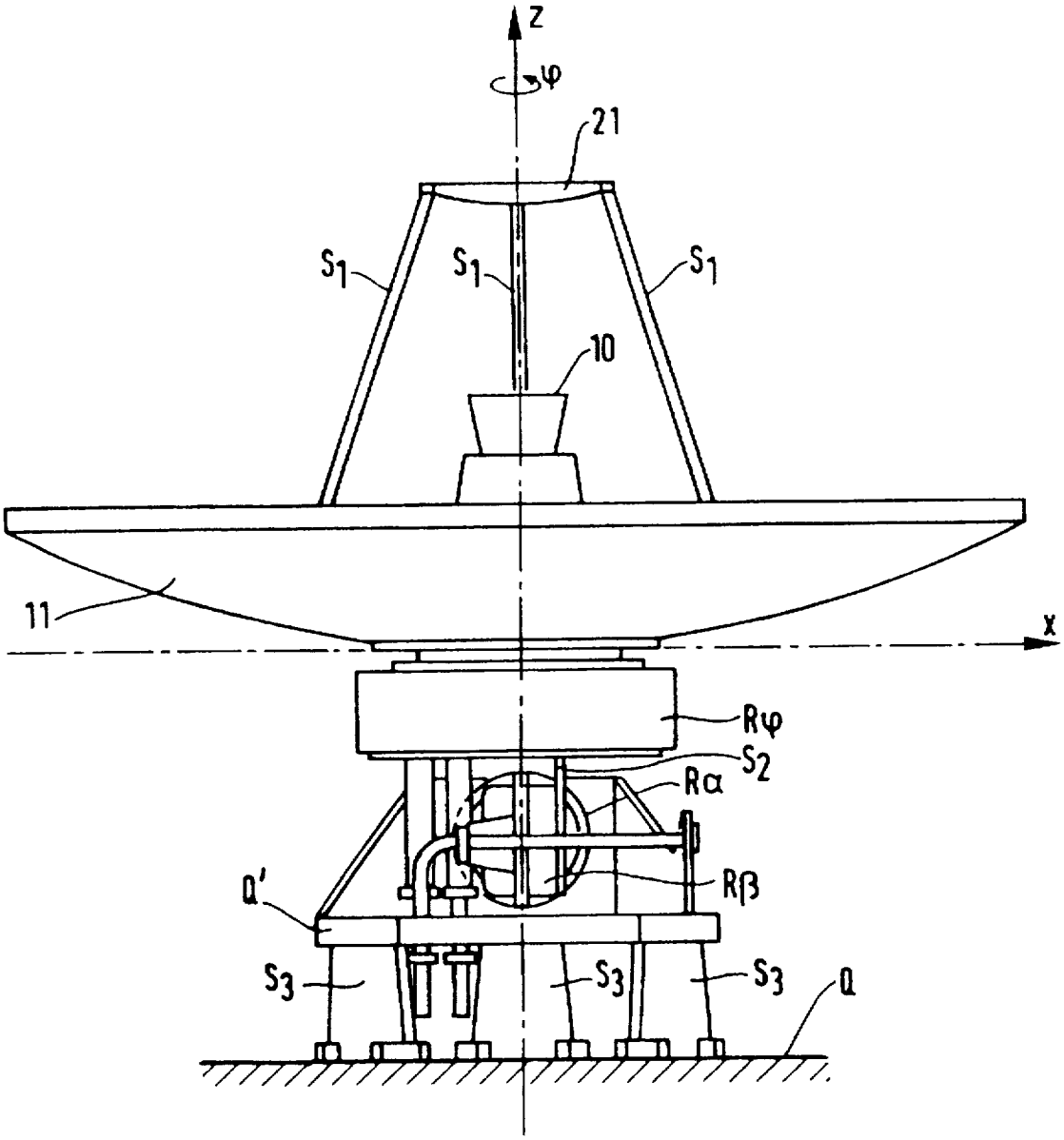
FIG. 8 is a diagrammatic side view of one embodiment of a Cassegrain antenna in accordance with the invention.

FIG. 8 is a diagrammatic plan view of one embodiment of an orientable Cassegrain antenna of the invention with conservation of polarization. As in FIG. 5, the parabolic main reflector 11 is illuminated by the source 10 via the auxiliary hyperbolic reflector 21, one focus of which is at the focus of the main parabolic reflector 11. The relative positions of the two reflectors (11, 21) are fixed by mechanical supports $S_1$.

The combination of the source (10), the reflectors (11, 21) and the mechanical positioning means (depointing, rotation) is fixed relative to the platform Q (which is a satellite, for example) by supports $S_3$.

The positioning means include three stepper motors (Rφ, Rα, Rβ) capable of effecting the angular displacement (φ, α, β) explained with reference to FIG. 6. These means are mounted on a small platform Q' which rests on the supports $S_3$.

The depointing means (Rα, Rβ) are fixed to the small platform Q' and drive the support $S_2$ which supports the axial rotation motor Rφ. This axial rotation motor Rφ is mechanically fixed to the main reflector 11 to rotate the latter (by an angle φ) about the main axis z. Unlike the prior art antennas, rotation of the main reflector 11 does not rotate the source 10, which is not fixed to the reflector 11.

The source 10 is fed with two orthogonal polarizations which also remain fixed relative to the source 10 upon rotation (angle φ) of the main reflector.

Figure 9:
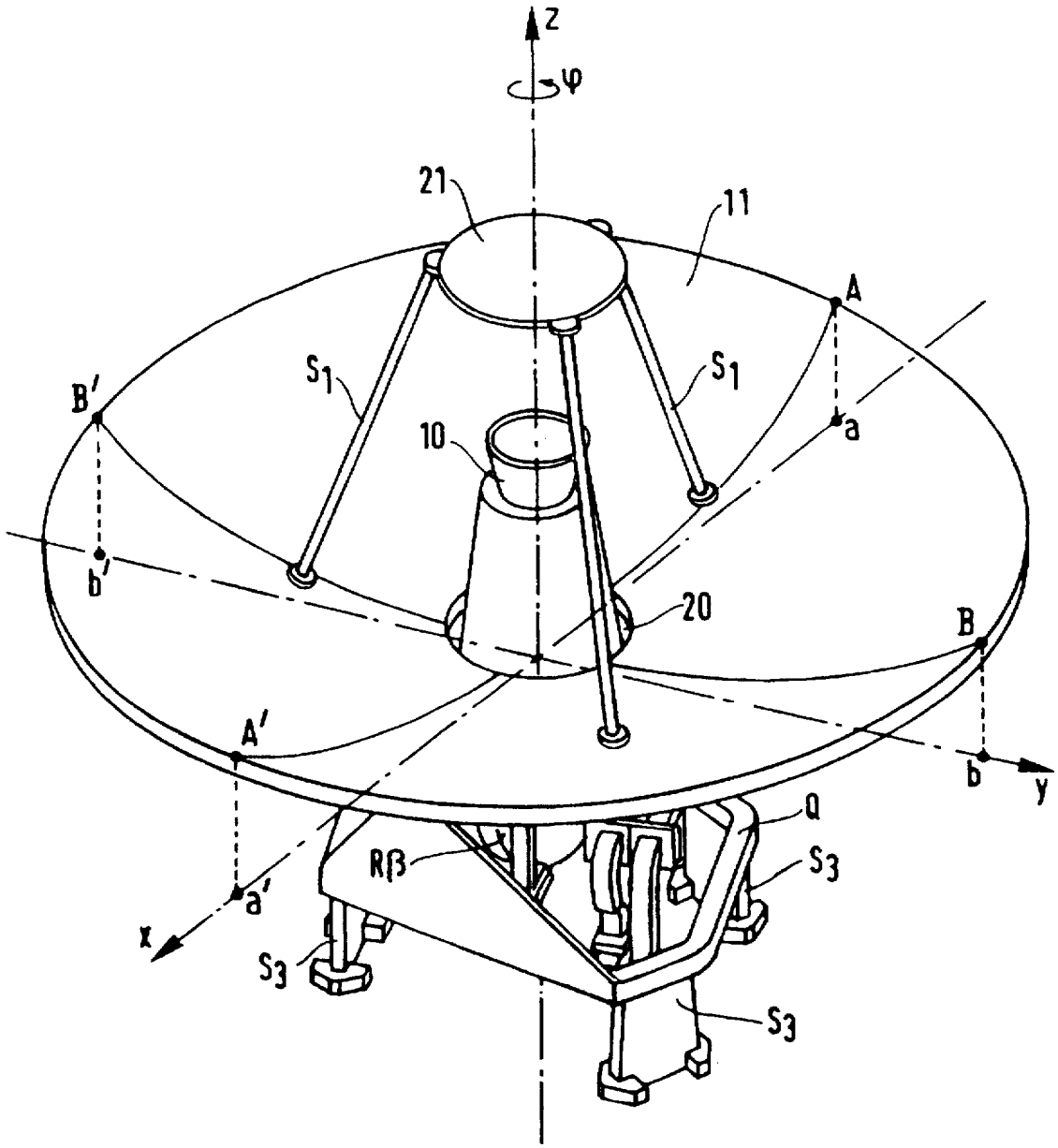
FIG. 9 is a diagrammatic three-dimensional view from above of the FIG. 8 embodiment of the invention.

FIG. 9 is a three-dimensional perspective view from above of the FIG. 8 embodiment of the invention. Components already described with reference to FIG. 8 carry the same reference numbers. The source 10 passes through a hole 20 in the main reflector 11 without mechanical contact. This feature, already part of the centered Cassegrain geometry, is exploited by the invention to isolate the source 10 from rotation about the z axis (angle φ) of the main reflector and the auxiliary reflector fixed to the main reflector 11.

The orthogonal cross-sections (A, A'; B, B') of the main reflector 11 are parabolas as in FIGS. 4A, 4B, 4C and 6.

The projections of the points A, A'; B, B' onto the x, y plane are respectively the points a, a'; b, b' and set the lateral dimensions of the main reflector 11 and the auxiliary reflector 21 fixed to the main reflector 11 by the supports $S_1$. In the most general case, and as shown in FIG. 6, these lateral dimensions (aa', bb') are not the same and the cross-section of the beam F (not shown) can have an arbitrary shape dictated by the shape of the perimeter of the main reflector 11, which is elliptical in this example.

As shown in FIG. 9, the source 10 in this example is a horn, but any other technology known to the person skilled in the art could be used. For example, the source 10 could be an array of individual sources implemented in the microstrip ("patch") technology.

Figure 10:
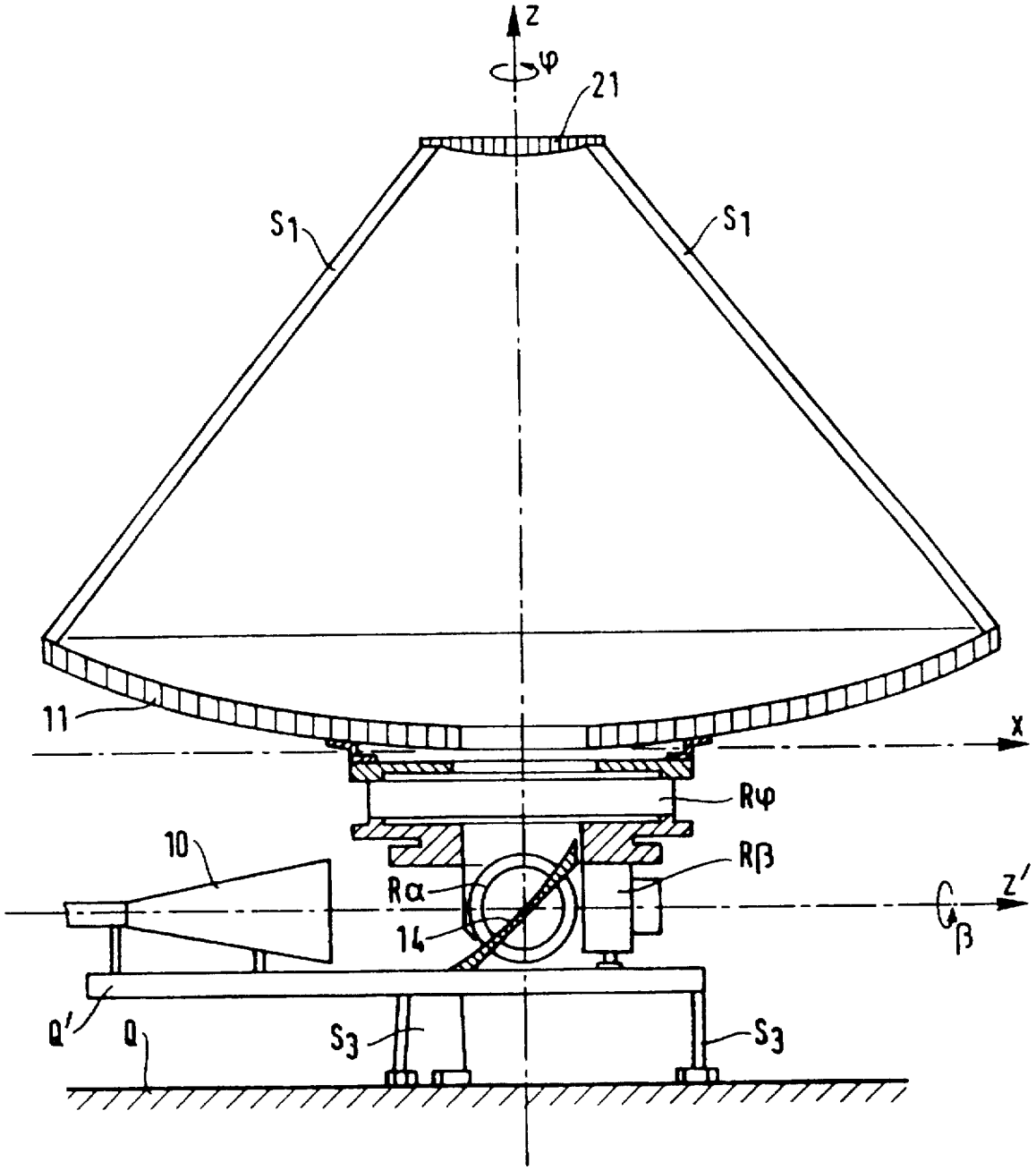
FIG. 10 shows another embodiment of an antenna of the invention in axial cross-section with a centered Cassegrain geometry, an auxiliary periscopic reflector and an offset source.

FIG. 10 is a diagrammatic view in axial section of another embodiment of the invention which represents a variant of the antenna shown in FIGS. 8 and 9.

This is a centered Cassegrain geometry antenna to which has been added a periscopic auxiliary reflector 14 which receives radiation from the source 10 offset on the z' axis parallel to the x axis and perpendicular to the main axis z. The auxiliary reflector 14 is disposed so that it reflects radiation from the source 10 along the z axis to illuminate the hyperbolic auxiliary reflector 21. In every other regard, the description with reference to FIGS. 8 and 9 applies here also.

The source 10 remains fixed relative to the platforms Q and Q', even on rotation (angle φ) of the main reflector and the auxiliary reflector 11 by the motor Rφ. In the event of depointing (angle α) in the x, z plane, the position of the auxiliary reflector 14 is adjusted to maintain the reflected radiation from the source 10 on the main axis z to illuminate the auxiliary reflector 21.

Figure 11:
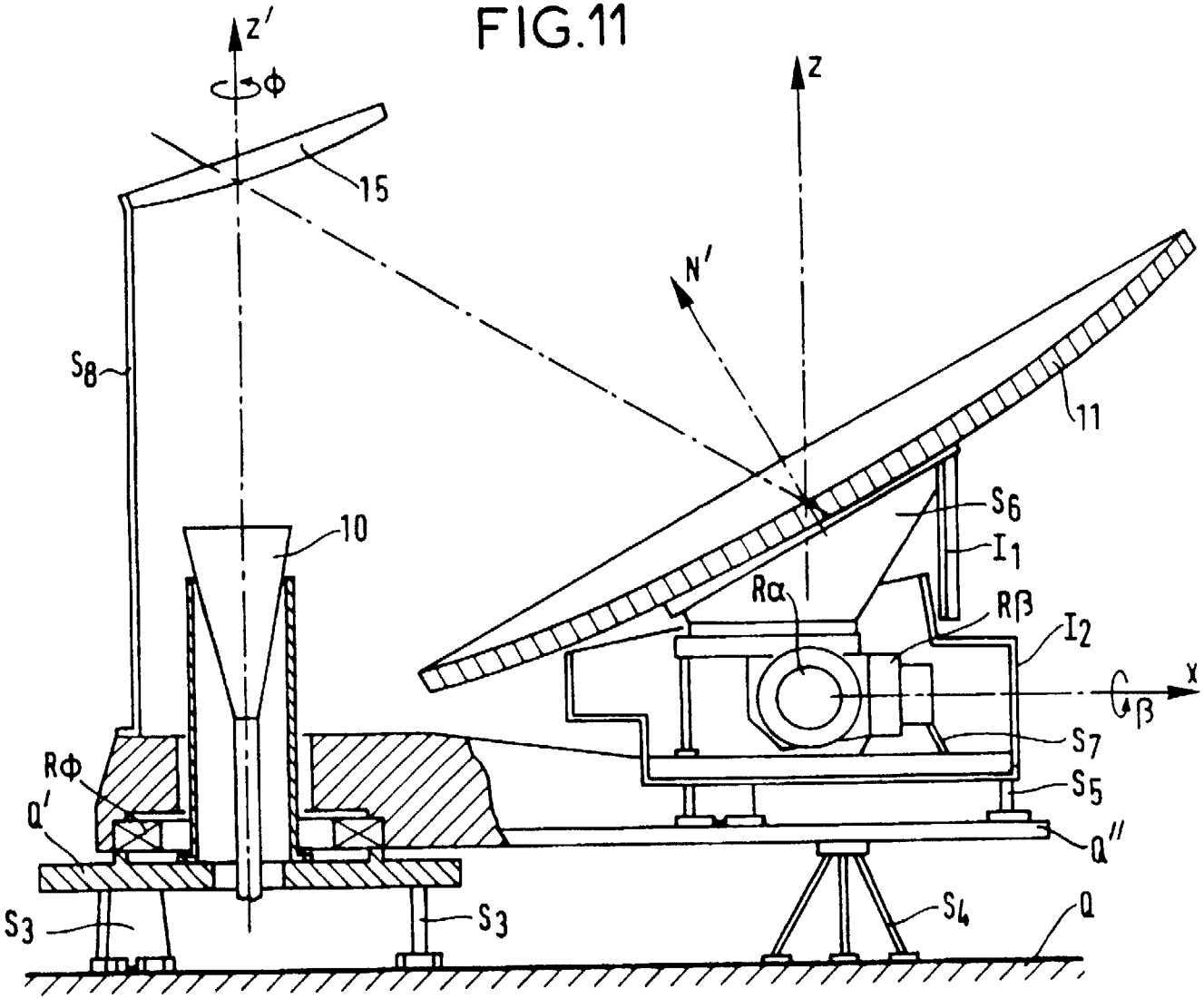
FIG. 11 is a diagrammatic view partly in cross-section of another embodiment of an antenna of the invention using an offset Cassegrain geometry.

FIG. 11 is a diagrammatic view partly in cross-section of another embodiment of the invention with an orientable offset Cassegrain antenna with conservation of polarization. As in the previous figures, the parabolic main reflector 11 is illuminated by the source 10 via an auxiliary reflector 15. The main reflector is offset illuminated by the auxiliary reflector at an angle $\delta$ relative to the normal N' to the apex of the main reflector 11; the beam F (not shown) is reflected at the same angle $\delta$ to the normal N' along the main axis z.

In this example depointing of the beam is achieved by positioning of the main reflector by the means $R\alpha$, $R\beta$. Different static support mechanical means are shown ($S_5$, $S_6$, $S_7$) together with a removable support $S_4$ which supports the platform Q" on the main axis z whilst allowing it to move in a plane perpendicular to z. This figure also shows various thermal insulation means ($I_1$, $I_2$).

In the FIG. 11 example the main axis z is far from the illumination axis z' of the auxiliary reflector 15 and the two axes are parallel. A mobile platform Q" on which are mounted the main reflector 11 and its support means ($S_5$, $S_6$, $S_7$) and depointing means ($R\alpha$, $R\beta$) can be displaced by the means $R\phi$ through an angle $\phi$ about the primary illumination axis z. Because the source 10 remains fixed relative to the platform Q (which is a satellite, for example) on rotation by an angle $\phi$ about the axis z' the polarization axes remain invariant relative to the platform Q.

The support means $S_8$ for the auxiliary reflector 15 join the latter to the mobile platform Q" so that rotation of the latter does not modify the relative geometry of the main and auxiliary reflectors 11 and 15.

These few examples illustrate the principles and a few embodiments of the invention on the basis of which the person skilled in the art will know how to adapt the invention to the specific needs of a given mission. In these examples the depointing means are mechanical in nature and operate on the main reflector but the invention can also use electronic depointing (by phase shifting the individual sources of an array) or depointing by mechanical means operating on an auxiliary reflector, possibly a periscope reflector.

Rotation of the spot formed on the ground without rotation of the polarization can be achieved through rotation of an angle $\phi$ about the main axis (z) or by rotation through an angle $\phi$ of the system of reflectors about the primary illumination axis z' or by rotation by an angle $\phi'$ about a depointed main axis $\vec{u}$. In all cases decoupling of the depointing means and the means for rotation about one of the electromagnetic radiation propagation axes (z, z', $\vec{u}$) enables orientation of the beam and conservation of polarization. Conversely, it is obvious that this same decoupling enables the antenna of the invention, subject to mechanical adaptations, to rotate the polarization axes whilst maintaining the orientation of the beam fixed, although this capability is not needed for the intended applications of the examples as described. This invention is directed to an alternate embodiment in the form of an antenna including at least one reflector and at least one source of electromagnetic radiation. Each source is capable of transmitting and/or receiving radiation in a primary direction joining the source to at least one reflector. Each source may include at least one radiating element and means for exciting said element. Such antenna is adapted to transmit or receive a beam of electromagnetic radiation of arbitrary cross-section and in a preferred direction of radiation. The preferred direction is determined by the disposition and orientation of the reflector and of the source. The reflector may be a dual gridded reflector of any shape with the beam of radiation having orthogonal polarization axes conferred on the beam by the orientation of the grids of the reflector. The beam may be oriented by movement of the antenna or its component parts. Further, the antenna may include mechanical means for determining the relative disposition of the reflector and the source and for effecting a rotation about an axis of propagation of the electromagnetic radiation while keeping the dual gridded reflector in a position so that the polarization axes of the beam remain fixed on the rotation of the source.

There is claimed:

1. Antenna including at least one reflector and at least one source of electromagnetic radiation, each said at least one source being capable of transmitting and/or receiving radiation in a primary direction which links said at least one source to at least one reflector; each said at least one source including at least one radiating element and means for exciting said element, said antenna being adapted to transmit or to receive a beam of electromagnetic radiation of arbitrary cross-section and in a preferred radiation direction determined by a disposition and an orientation of said reflector and said at least one source, said beam having polarization axes conferred on said beam by the excitation applied to said at least one source, said beam being orientable by movement of one of said antenna and component parts of said antenna, and said antenna further including mechanical means for defining a relative disposition of said reflector and said at least one source and for rotating said reflector about an electromagnetic radiation propagation axis while holding said at least one source in a position such that the polarization axes remain fixed during said reflector rotation, wherein said mechanical means comprises depointing means for rotating said reflector about first and second orthogonal axes, said depointing means driving a support which supports an axial rotation motor for rotating said reflector about the electromagnetic radiation propagation axis without also rotating said at least one source.

2. Antenna according to claim 1 wherein said rotation is a rotation $\phi$ about the main axis which represents the preferred direction of radiation of the beam, and said means for effecting rotation comprising mechanical rotation means which operates on the disposition of said at least one reflector, leaving the position of said source unchanged, and maintaining the polarization axes fixed.

3. Antenna according to claim 1 wherein said rotation is a rotation $\phi$ about an auxiliary axis which joins the source and an auxiliary first reflector, and said means for effecting rotation comprises mechanical rotation means which operates on the disposition of at least one reflector leaving the position of the source unchanged.

4. Antenna according to claim 1 wherein said auxiliary axis is the same as said preferred direction and said antenna has a coaxial geometry.

5. Antenna according to claim 1 having an offset or centered Cassegrain geometry.

6. Antenna according to claim 1 having a parabolic main reflector illuminated by a source disposed at its focus and means for turning said reflector about said preferred radiation direction while said source is held fixed.

7. Antenna according to claim 1 having an offset or centered Gregorian geometry.

8. Antenna according to claim 1 further including depointing means for chancing said preferred direction while holding the polarization axes fixed in a spot.

9. Antenna according to claim 1 constituting a transmit antenna.

10. Antenna according to claim 1 constituting a receive antenna.

11. Antenna according to claim 1 constituting a transmit/receive antenna.

12. Antenna according to claim 1 wherein said at least one source comprises a complex primary source.

13. Antenna according to claim 12 wherein said complex primary source includes a plurality of separate sources and said antenna further includes at least one polarization-selective reflector.

14. Antenna according to claim 12 wherein said complex primary source includes a plurality of separate sources and said antenna further includes a plurality of frequency-selective reflectors.

15. Antenna according to claim 12 wherein said complex primary source includes at least one periscopic source.

16. Antenna as recited in claim 1, wherein said at least one source passes through an opening in said reflector without contacting said reflector.

17. Antenna as recited in claim 1, further comprising a periscopic auxiliary reflector for reflecting the radiation from said at least one source to said reflector.

18. Antenna as recited in claim 17, further comprising a platform for supporting said at least one source and said depointing means, wherein said at least one source remains fixed relative to said platform when said reflector is rotated by said axial rotation motor.

19. Antenna including at least one reflector and at least one source of electromagnetic radiation, each said at least one source being capable of transmitting and/or receiving radiation in a primary direction which links said at least one source to at least one reflector; each said at least one source including at least one radiating element and means for exciting said element, said antenna being adapted to transmit or to receive a beam of electromagnetic radiation of arbitrary cross-section and in a preferred radiation direction determined by a disposition and an orientation of said reflector and said at least one source, said beam having polarization axes conferred on said beam by the excitation applied to said at least one source, said beam being orientable by movement of one of said antenna and component parts of said antenna, and said antenna further including mechanical means for defining a relative disposition of said reflector and said at least one source and for rotating said reflector about an electromagnetic radiation propagation axis while holding said at least one source in a position such that the polarization axes remain fixed during said reflector rotation, wherein said at least one source is supported on a first platform and said reflector is supported on a second, mobile platform, and wherein said at least one source remains fixed relative to said first platform on rotation by said second, mobile platform around said first platform, and further comprising depointing means on said second, mobile platform for rotating said reflector about first and second orthogonal axes.

20. Antenna as recited in claim 19, wherein said second, mobile platform is rotatably coupled to said first platform.

21. Antenna as recited in claim 20, further comprising an auxiliary reflector fixed to said second, mobile platform adjacent to said at least one source for reflecting radiation from said at least one source to said reflector.

* * * * *